US005338116A

United States Patent [19]

Spörl

[11] Patent Number: 5,338,116

[45] Date of Patent: Aug. 16, 1994

[54] GUIDE MEANS FOR A SUBMERSIBLE MIXER AND THE LIKE

[75] Inventor: Helmut Spörl, Naila, Fed. Rep. of Germany

[73] Assignee: E+M Maschinenbau GmbH, Hof/Saale, Fed. Rep. of Germany

[21] Appl. No.: 914,183

[22] Filed: Jul. 15, 1992

[30] Foreign Application Priority Data

Jul. 17, 1991 [DE] Fed. Rep. of Germany ..... 4123664

[51] Int. Cl.[5] ..... B01F 7/06

[52] U.S. Cl. ..... 366/286; 366/261

[58] Field of Search ..... 366/241, 242, 244, 245, 366/247, 249-252, 254, 261, 285, 286, 264; 114/313; 166/341-343; 187/62, 95

[56] References Cited

U.S. PATENT DOCUMENTS

| | | | |
|---|---|---|---|
| 1,916,042 | 6/1933 | Edgar | 366/285 |
| 3,171,635 | 3/1965 | Haentjens | 366/286 |
| 3,358,753 | 12/1967 | Haeber | 166/343 |
| 4,111,611 | 9/1978 | Andersson | 187/95 |
| 4,395,160 | 7/1983 | deJong | 114/264 |
| 4,472,081 | 9/1984 | Lawson | 166/341 |
| 4,581,181 | 4/1986 | Nicholls | 114/264 |
| 4,581,182 | 4/1986 | Cramer | 366/261 |
| 4,808,040 | 2/1989 | Lisi | 366/286 |
| 5,020,641 | 6/1991 | Olsen | 187/95 |

FOREIGN PATENT DOCUMENTS

| | | | |
|---|---|---|---|
| 2950058 | 6/1981 | Fed. Rep. of Germany | 366/261 |
| 3941724 | 6/1991 | Fed. Rep. of Germany | 366/285 |
| 52373 | 3/1944 | France | 366/241 |

*Primary Examiner*—Timothy F. Simone
*Assistant Examiner*—Terrence R. Till
*Attorney, Agent, or Firm*—Townsend and Townsend Khourie and Crew

[57] ABSTRACT

A device for guiding a submersible mixer 1 through a receptacle comprises two cable sections 7 having upper ends fixed to the receptacle and lower ends received by supporting members 10 mounted to the bottom surface of the receptacle. A guide slide 4, alternatively attached to the receptacle and the submersible mixer by two connecting elements 13, has two tubular posts 60, 61 that are slidably coupled to the cable sections 7. After lowering the submersible mixer 1 onto the guide slide 4, the connecting elements 13 are detached from the receptacle and attached to the submersible mixer, one after the other, so that the guide slide 4 is firmly anchored to the receptacle until the submersible mixer 1 is secured to the guide slide 4. The guide slide 4, with the submersible mixer 1 secured thereon, is then lowered through the receptacle and onto the two supporting members 10 so that the submersible mixer 1 can conduct operations in the receptacle.

16 Claims, 8 Drawing Sheets

GUIDE MEANS FOR A SUBMERSIBLE MIXER AND THE LIKE

Figure 1D:
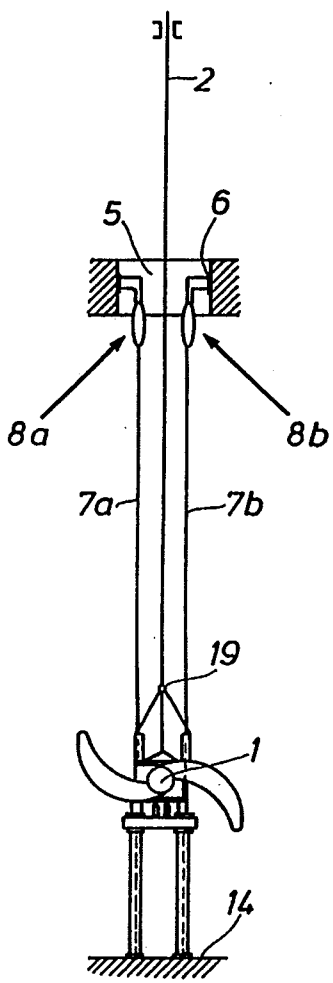
Figure 1C:
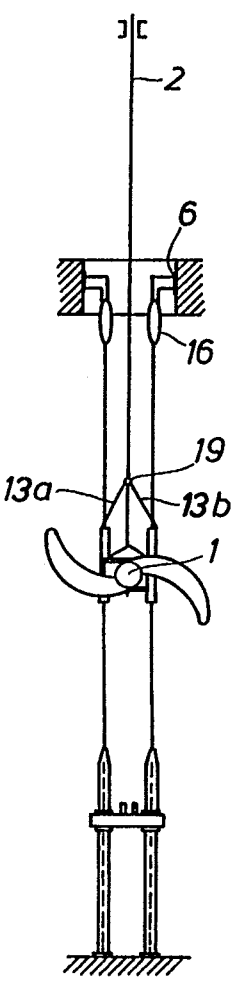

The invention relates to a guide means for a submersible mixer.

A guide means of prior art comprises two tubular guide posts serving to dispose the submersible mixer by means of a winch cable in the vicinity of the bottom of a receptacle in which position the submersible mixer then commences operation. In deep receptacles, particulary at depths exceeding roughly 10 m, the flow path generated by the submersible mixer results in such an unstable condition of the supporting posts that they can possibly break or be caused to vibrate to such an extent that satisfactory support of the submersible mixer is no longer assured.

A further disadvantage of known guide means is that in mounting the submersible mixer on the supporting posts, expedients such as bolts and the like need to be released, thus constituting the risk of such expedients dropping into the receptacle.

The object of the invention is based on improving the guide means of the aforementioned kind so that it can be employed without difficulty even in receptacle depths exceeding 10 m and without being detrimented by the flow path generated by the submersible mixer in the receptacle.

The invention achieves this object for a mixer guide means by providing at least two guide members located substantially parallel to each other and having cable sections, the guide members being secured or supported at their bottom end in a receptacle, wherein the guide members end at their upper end at the wall of a receptacle or in a cover aperture of the receptacle, wherein each cable section of the guide members is secured by means of a connector in the region of the receptacle aperture, a bottom supporting member being provided for each guide member, the bottom end of each cable section being anchored to the bottom guide members, wherein a guide slide is provided for sliding adjustment along the guide members, said slide comprising at least tubular posts located substantially parallel to each other, the bottom end being taper extended in each case, wherein the supporting members are conically tapered at their upper end to achieve smooth placement or location of the tubular posts on the supporting members.

Further embodiments of the invention are formulated by the subclaims.

The invention provides a guide means which, especially due to cables, preferably of steel being used, produces an exceedingly low flow resistance so that the guide members are not subject to the risk of being ruined, whilst nevertheless ensuring that the submersible mixer and the like can be located in a stable operating position. The guide means ensures easy insertion of the submersible mixer in the receptacle by employing a guide slide which can be slide-adjusted along the guide members.

In one preferred embodiment of the guide means the submersible mixer is employed by means of a winch cable in a guide slide fixed in position with respect to the receptacle aperture, according to which the connecting means holding the guide with respect to the receptacle aperture are released one after the other towards the aperture of the receptacle and are firmly anchored to the casing of the submersible mixer or a support receiving the submersible mixer, according to which the submersible mixer can be lowered together with the guide slide to the operating position in the vicinity of the bottom of the receptacle.

Figure 1B:
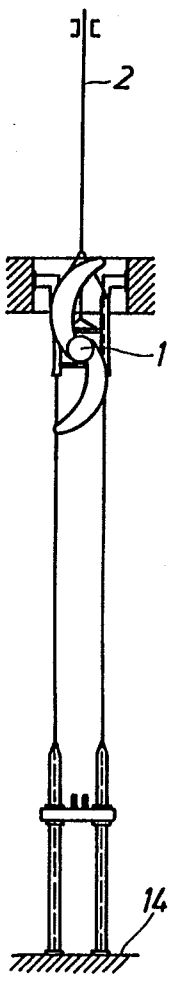
Figure 1A:
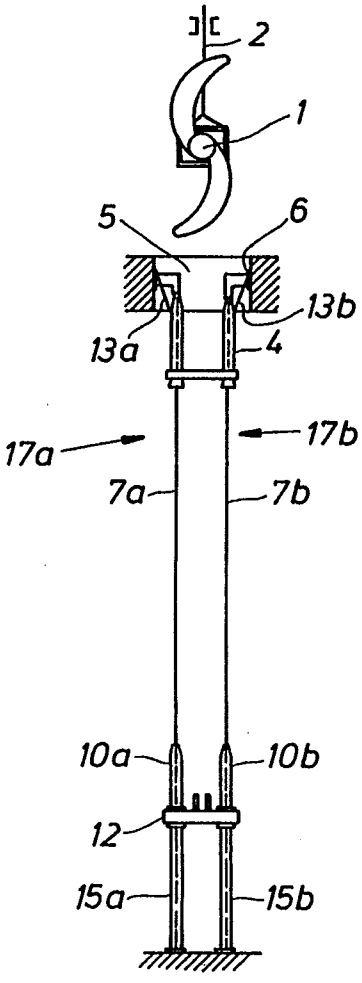
Figure 3A:
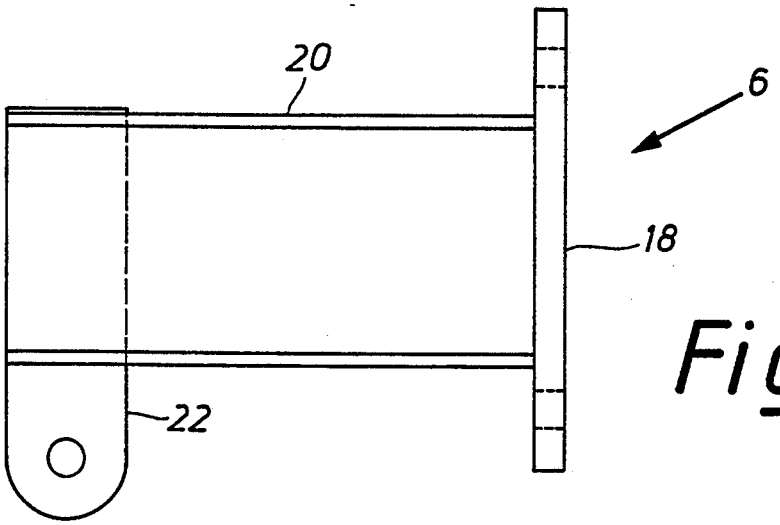
Figure 3B:
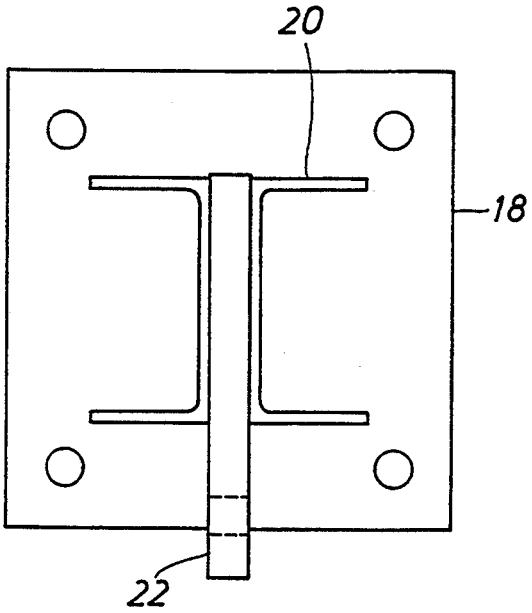
Figure 3C:
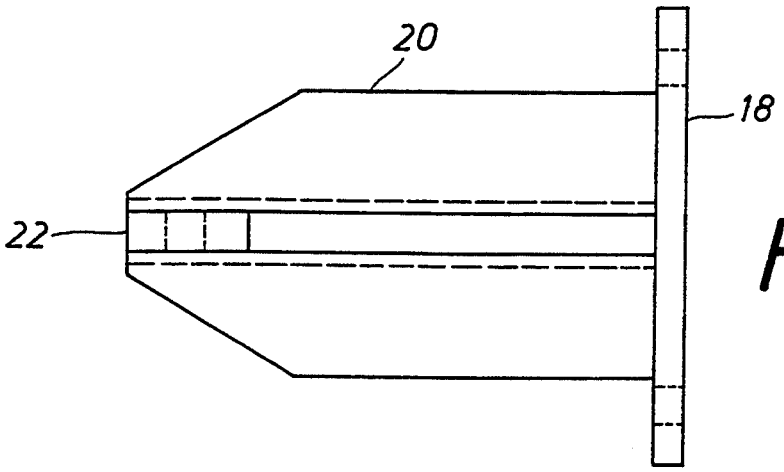
Figure 4A:
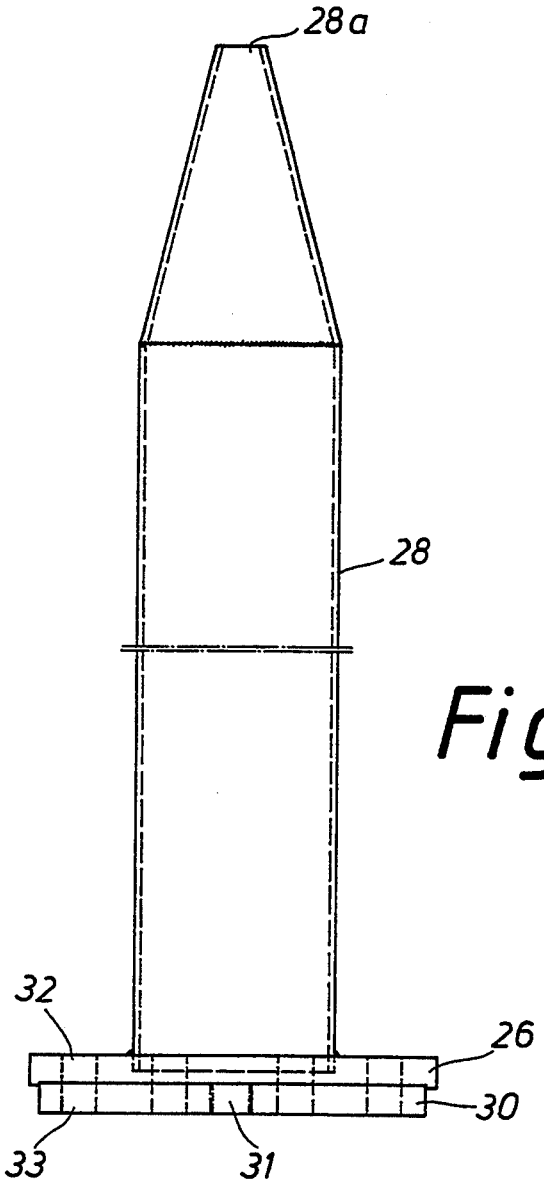
Figure 4B:
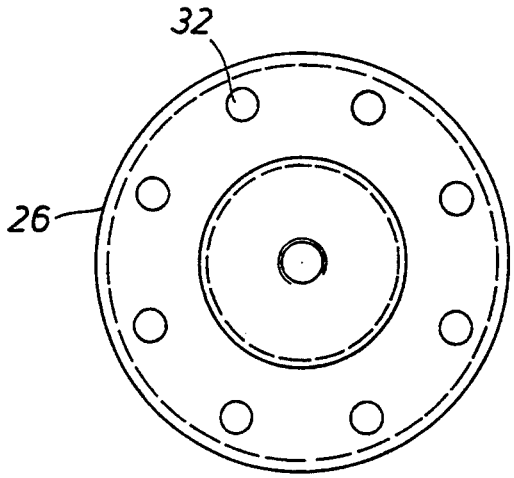
Figure 5C:
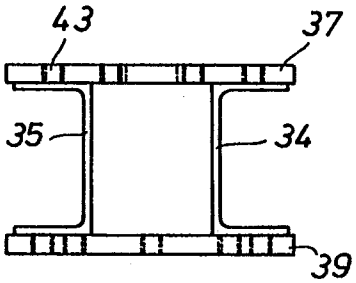
Figure 2:
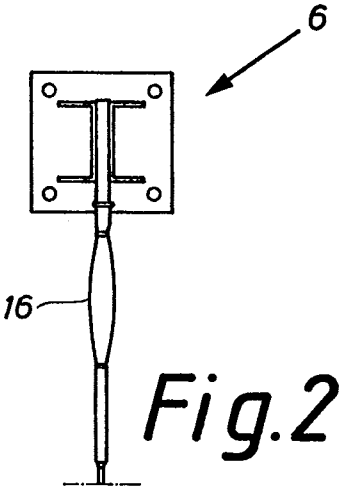
Figure 5A:
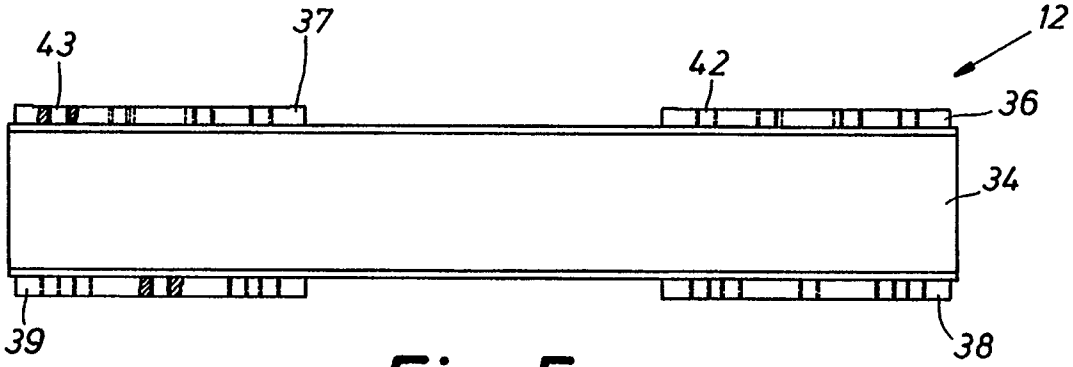
Figure 5B:
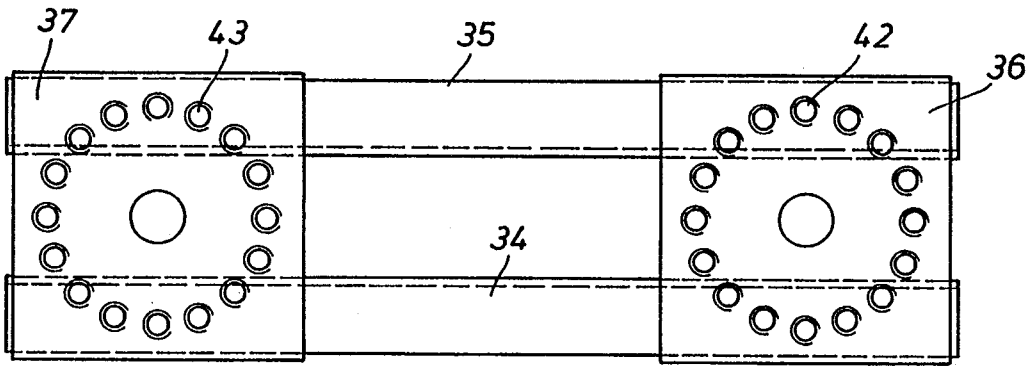
Figure 6A:
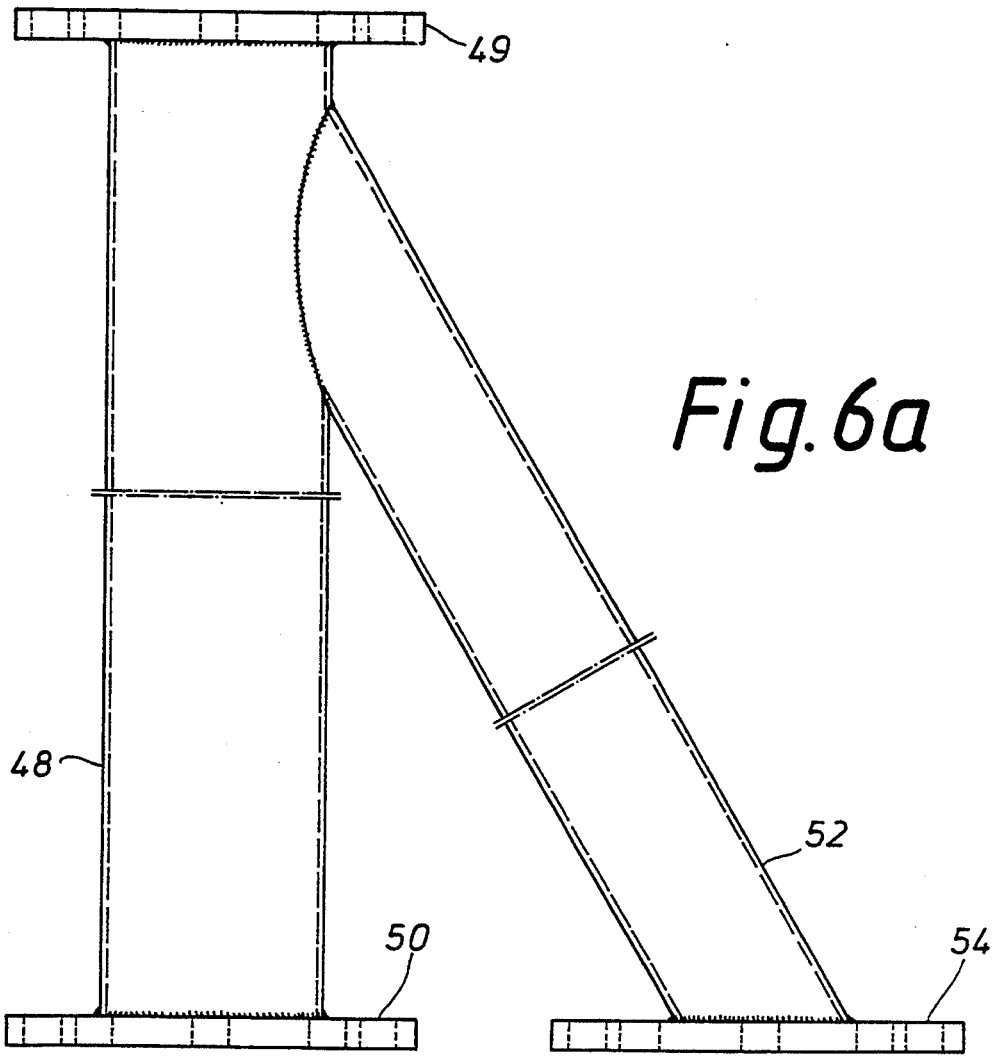
Figure 6B:
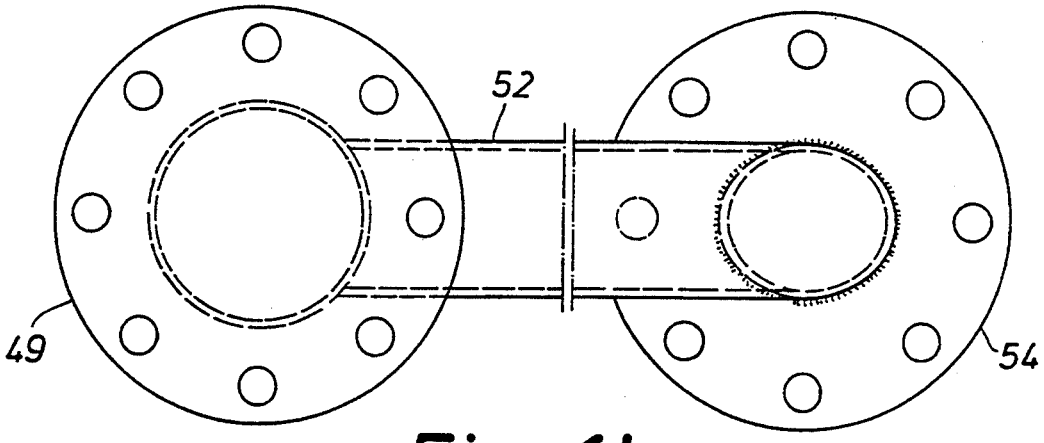
Figure 7B:
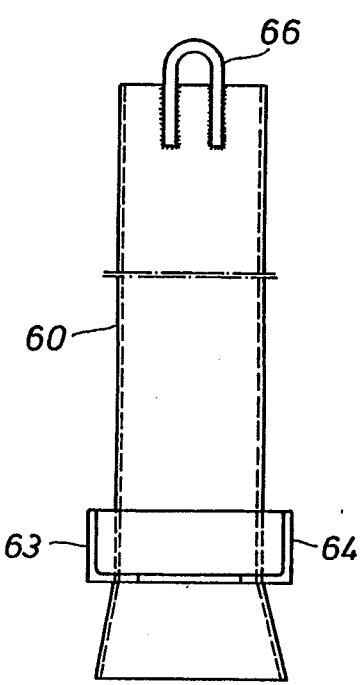
Figure 7A:
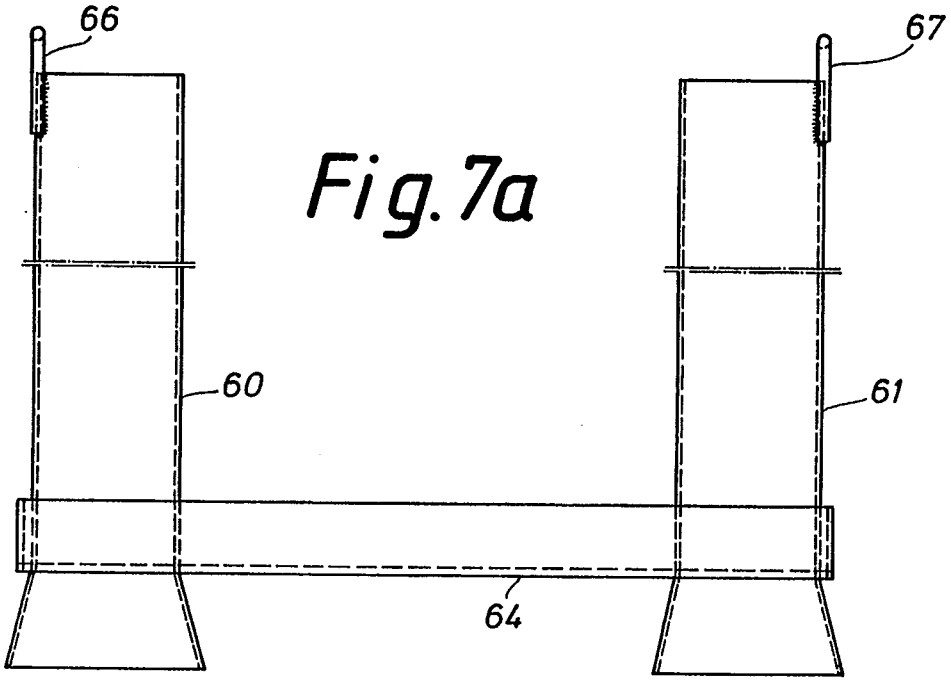
Figure 7C:
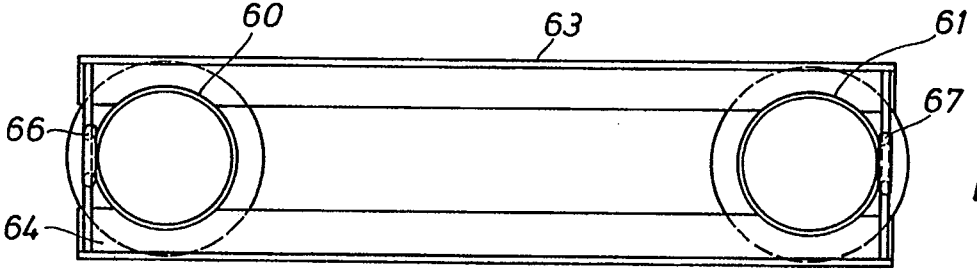
Figure 8A:
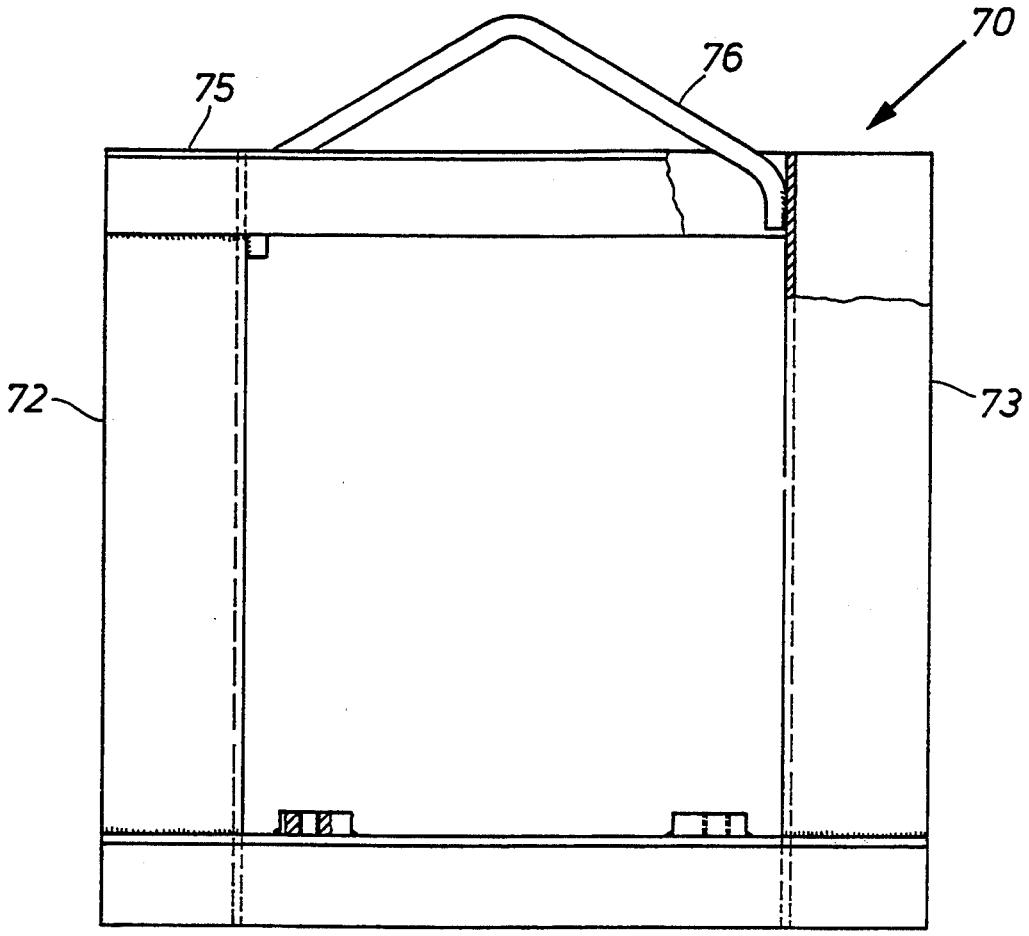
Figure 8B:
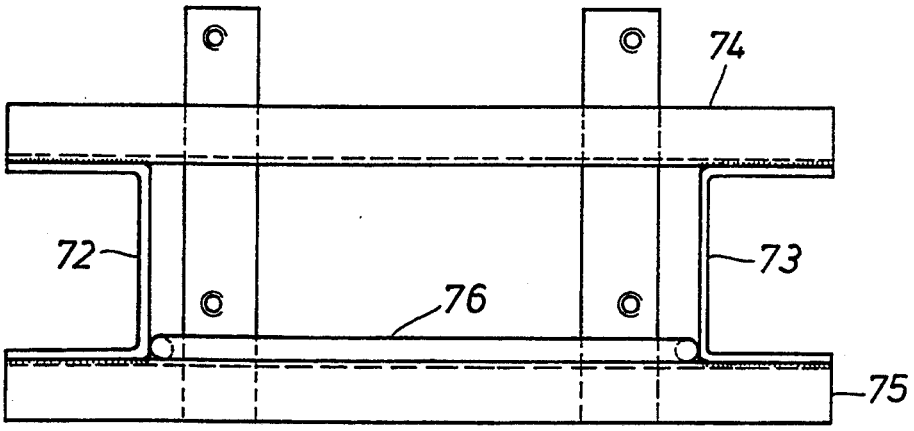
Figure 9:
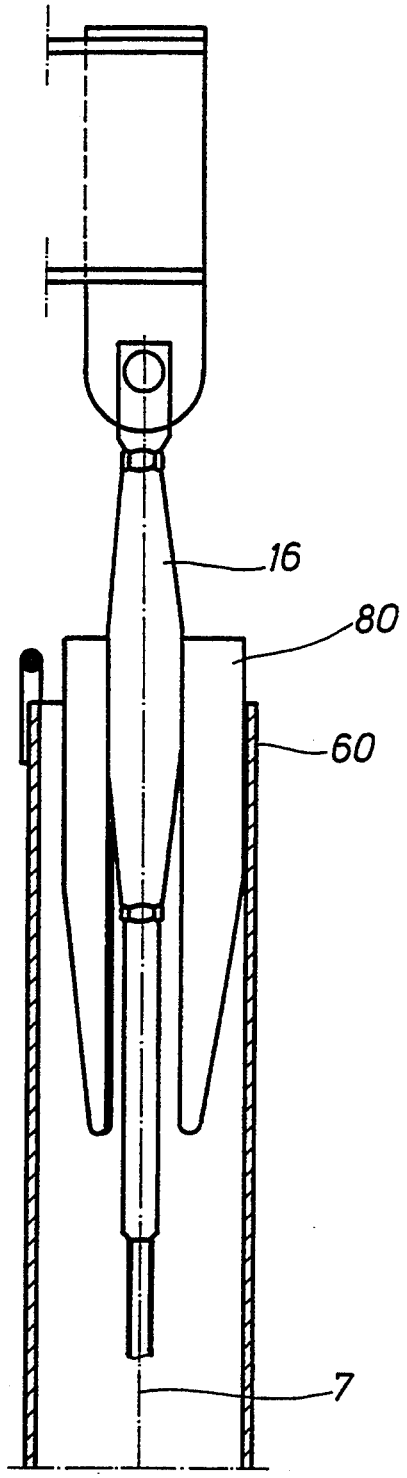

The guide means according to the invention will now be described by means of the drawing to explain further advantages and features, in which FIG. 1*a–d* are a schematic illustrations of the guide means to explain the working sequence in lowering a submersible mixer into position FIG. 2 is a section view to explain how the cable sections are secured in the region of the receptacle aperture, FIG. 3*a* thru 3*c* show a preferred embodiment of the guide bracket depicted in FIG. 2, FIG. 4*a* and 4*b* are schematic illustrations of a supporting member, FIG. 5*a* thru 5*c* are views of a preferred support for the submersible mixer and the like FIG. 6*a* and 6*b* are views of a preferred embodiment of means for spacing the submersible mixer support according to FIGS. 5*a* and 5*b* with respect to the bottom of the receptacle, FIG. 7*a* thru 7*c* are schematic illustrations of a preferred embodiment of a guide slide, FIG. 8*a* and 8*b* show a slide for receiving the submersible mixer, and FIG. 9 shows a preferred embodiment of means for centering the guide slide.

With reference to the drawings one preferred embodiment of the guide means according to the present invention will now be described.

FIG. 1 schematically illustrates the complete guide means and the way in which a submersible mixer is disposed downwards. The submersible mixer is identified in FIG. 1 by reference numeral 1 and can be adjusted at least vertically by means of a cable 2 connecting a winch (not shown). According to one preferred embodiment the submersible mixer 1 is seated in a receiving frame, designed dimensionally compatible with a guide slide. Details of the frame receiving the submersible mixer will now be explained in conjunction with FIG. 7.

The receptacle is indicated merely schematically in FIG. 1 and features a receptacle aperture 5 in which guide brackets 6 are fitted. The guide brackets 6 serve to support one cable each, preferably steel cables 7*a*, 7*b* having at the upper end a connecting part 8*a*, 8*b* e.g. in the form of a shroud tensioner suitably connected to the corresponding guide bracket 6 so that each guide bracket 6 holds a steel cable 7*a*, 7*b* which is firmly connected at its bottom end to a supporting member 10*a*, 10*b*. The length of each steel cable 7*a*, 7*b* is selected so that it receives a prescribed tension in the operating condition as shown in FIG. 1. The supporting members 10*a*, 10*b* are, in turn, mounted in a support 12 which are fixed either directly to the receptacle bottom 14 or via fixtures 15*a*, 15*b* at a certain distance away from the receptacle bottom.

As shown at a in FIG. 1 the submersible mixer 1 is suspended in the frame (not depicted further) above the receptacle aperture 5 and is introduced, by lowering the winch cable 2, as shown in FIG. 1*b*, into the guide slide 4 which, as shown in FIG. 1*a*, is attached via connecting elements 13*a*, 13*b* in the region of the receptacle aperture 5, for instance in the guide brackets 6. As soon as the submersible mixer 1 is located on the guide slide 4 the connecting elements 13*a*, 13*b* are connected one after the other to the frame or casing of the submersible mixer 1, i.e., for example, first the connecting element 13*a* is released with respect to the fastener in the region of the receptacle aperture 5, before the same is done with respect to the connecting element 13*b*. This procedure eliminates the risk of accidental lowering of the guide slide 4 and spacing away of the same with respect to the submersible mixer 1 as shown in FIG. b. The mixer 1 can then be lowered into the receptacle, as shown in FIG. 1*c*, by releasing the winch cable 2 until the submersible mixer 1 comes to rest on the support 12 at the prescribed distance away from the bottom 14 of the receptacle, where it assumes its fixed, prescribed operating position. After this, the submersible mixer can start operation.

In the embodiment of the invention as shown the submersible mixer features within its casing a gear unit and a motor and thus in addition a power feed cable extends from the receptacle aperture to the submersible mixer 1 which may take the same course as the winch cable 2.

Lifting the submersible mixer is done in the reverse sequence of the procedure described.

As shown in FIG. 1 the connecting elements 13*a*, 13*b* used are cables which after releasing the end assigned to the receptacle aperture 5 are attached to an eye 19 provided on the winch cable 2.

FIG. 2 shows one possibility of securing the guide members identified by 15*a* and 15*b*. In accordance with this embodiment each guide cable 7*a* or 7*b* of the guide members 17*a* and 17*b* respectively is provided in the region of the receptacle aperture 5 with a connecting part 16, e.g. in the form of a shroud tensioner which, in turn, is attached in a separate guide bracket 6 for each guide member 15*a*, 15*b*, each guide bracket being located either in the region of the receptacle aperture 5 or in the aperture of a cover (not shown) of the receptacle. In this arrangement the guide brackets 6 are disposed away from each other so that the required spacing of the guide members 15*a*, 15*b* from each other is maintained which, in turn, is determined by the spacing of the parts (described later) of the guide slide 4. In the embodiment shown in FIG. 2 each guide bracket 6 is bolted in the region of the receptacle aperture 5 to the edge of the receptacle. If necessary, a single guide bracket can also be provided to secure the two connecting parts 16.

FIGS. 3*a* and 3*b* show a preferred embodiment of a guide bracket comprising a plate 18 which according to this embodiment is to be mounted in vertical direction and features an arm 20 extending away from the plate 18 more or less horizontally, which is preferably formed by two channel sections arranged back-to-back and featuring a projection 22 at its free end, facing downwards and having at its bottom end an aperture or eye 22 and the like, for the purpose of providing the upper fixed support for the steel cable 7*a* and 7*b* respectively. The part containing this aperture or eye 22 can also be employed sandwichwise between the two channel sections forming the arm 20.

FIG. 3*c* is a plan view of the guide bracket 6. From FIG. 3*c* it will be seen that the arm 20 is formed conically tapered at its free end to minimize obstruction in introducing the submersible mixer through the receptacle aperture at bracket 6.

FIGS. 4*a* and 4*b* show a preferred embodiment of the supporting members 10*a*, 10*b*, according to which each supporting member 10*a*, 10*b* of this embodiment comprises a plate 26 to which a taper-pointed tubular post 28 is secured, e.g. welded. Beneath plate 26 a further plate 30 is provided for firmly connecting to the former and thereby forming a bottom fixed support for the corresponding steel cable 7*a* and 7*b* respectively. This bottom fixed support, identified by 31 in FIG. 4*a*, comprises in this embodiment a tapping 31 formed in the middle of plate 30 to receive a threaded fitting firmly connecting the steel cable. The upper aperture 28*a* of the tubular post 28 is selected sufficiently large to permit introduction of the threaded fitting (not shown) through this aperture 28*a* into the inside of the tubular post 28 when fitting the guide means of the present invention.

The plates 26,30 have an outer diameter which is larger than that of tubular post 28. The plates 26,30 are provided with a series of bores 32, 33 each aligned to the other and serving to receive the fasteners such as bolts to secure the supporting member on the support 12 (described later).

As shown in FIG. 4*b*, the plates 26, 30 are circular in shape and serve to secure the tubular post 28 firmly connected to plates 26,30 on the support 12. One preferred embodiment of the support 12 is explained in conjunction with FIGS. 5*a* and 5*b*. According to this embodiment the support 12 comprises two channel-sections 34, 35 arranged back-to-back as shown in FIG. 5*c* and carry separate upper and bottom securing plate 36 thru 39 as shown in FIG. 5*a* and FIG. 5*b*. These securing plates 36 thru 39 are preferably welded to the sections or beams 34, 35 to hold the plates 36,37 interspaced from the plates 38, 39. These preferably rectangular plates 36 thru 39 are provided with suitable bores 42, 43 etc. to serve connecting the plates 26,30. The support 12 can be connected by means of plates 38, 39 directly to the bottom 14 of the receptacle or mounted on the bottom of the receptacle 14 via additional means to space the support 12 away. This support 12 mainly serves to receive the submersible mixer, i.e. to support the submersible mixer 1 in its lowered operating position within the receptacle as defined by support 12.

The tubular posts 28 are formed conically tapered to the upper to ensure smooth placement or location of the guide slide 4 (described later) during lowering of the submersible mixer 1 together with the slide 4. This slide 4 is reliably guided by the conically tapered upper tubular post ends and moved over the tubular posts 28 down to the support 12.

The support shown in FIGS. 5*a* thru 5*c* comprises two interspaced fastener assemblies defined by the plates 36, 38 and 37, 39 where the invention calls for the guide means to comprise two guide members. In the majority of such guide members the support is to be converted according to FIGS. 5*a* thru 5*c*.

With reference to FIGS. 6*a* and 6*b* the following is a description of the means 15 which may be required to permit mounting the support 12 at the prescribed distance away from the bottom 14 of the receptacle. These means 15 also comprise two parts identified 15*a* and 15*b* in FIG. 1, one embodiment of which is shown in FIGS. 6*a* and 6*b*. Means 15 comprise a tubular post 48 and the like to be mounted vertically, having an upper and a lower fastening plate 49, 50 of which the lower plate 50 is bolted or welded to the receptacle bottom, whilst the upper plate 49 serves to connect plate 38 or 39 of the support 12. The length of the tubular post 48 depends on the spacing selected between the support 12 and the bottom 14 of the receptacle. Plates 49 and 50 are preferably welded to the tubular post 48. To additionally stabilize the means 15 a side strut 52 may be provided, preferably also in the form of a tubular post running at an angle to the bottom 4 of the receptacle. This strut 52 is firmly connected, preferably by welding, by its upper end to the upper part of tubular post 48. Strut 52 is arranged in the guide means shown in FIG. 1 so that it is located parallel to the direction of the flow generated through the submersible mixer, i.e. in FIG. 1 strut 52 is to be provided behind the tubular post 48 oriented vertical to the plane as defined by the two tubular posts 48 of the means 15*a*, 15*b*.

FIGS. 7*a* thru 7*c* show a preferred embodiment of a guide slide 4 to receive the submersible mixer 1. This guide slide 4 comprises two tubular posts 60, 61 located parallel to each other, the internal diameter of which is selected larger than the outer diameter of the supporting members supporting the guide slide 4 and also formed by tubular posts 28. Tubes 60, 61 are also interspaced as prescribed, for example, by angle brackets 63, 64 so that tubular posts 60, 61 are held spaced in the same spacing as that of the cables 7*a*, 7*b*. The tubular posts 60, 61 can also be interconnected by an embodiment different to that as shown in FIGS. 7*a*, 7*b*.

Tubes 60, 61 are conically tapered at their lower end to ensure smooth placement or location of these tubular posts on the supporting members 10*a*, 10*b* so that the guide slide 4 is able to be easily slided along the guide members 7*a*, 7*b*, the cross strut formed by the angle brackets 63, 64 serving to additionally support the submersible mixer 1.

The side view of the guide slide 4 according to FIG. 7*b* shows that to the side of tubular posts 60, 61 one connecting element 66, 67 each is provided serving to fix the connecting elements 13*a*, 13*b* to the guide slide 4. In the embodiment shown the connecting elements 66, 67 in the form of U-shaped eyes are welded to the side walls of the tubular posts 60, 61.

The guide slide 4 according to FIGS. 7*a*, 7*b* serves to receive the submersible mixer 1 which, for example, can be mounted firmly within a frame 70 as is more or less known as shown in FIGS. 8*a* and 8*b*. This frame 80 features two channel sections 72, 73 extending sideways which, as shown in FIG. 8*b*, are interspaced preferably by angle brackets 74, 75 provided at both the upper end and the lower end and result in a firm frame structure. The sections 72, 73 are shifted by downwards movement of the frame 70 into the guide slide 4 as shown in FIG. 1*b* with partial assistance of the tubular posts 60, 61, until the underside of the frame 70 comes to rest on the cross strut 63, 64. A bow 76 firmly connected to the frame 70 serves to deflect the winch cable 2. In FIGS. 8*a* and 8*b* the submersible mixer is not illustrated.

From the above description of the guide means according to the invention it results that the submersible mixer 1 mounted on the frame 70 is easily mounted on the guide slide 4 as evident from FIGS. 1*a* and 1*b* without requiring any bolts or other fastening means whatsoever to be released. Merely the means for capturing the guide slide in the form of connecting elements 13*a*, 13*b* need to be released with respect to the corresponding guide bracket 6 and connected to the casing or the frame 70 of the submersible mixer before the submersible mixer 1 can be lowered along the cables 7*a*, 7*b* down to the supporting member 10. Using cables 7*a*, 7*b* having a relatively small cross-section produces a more or less negligible resistance to the flow during operation of the submersible mixer 1, whilst being sufficiently stable to reliably hold the submersible mixer 1 in its operating position on the support 12.

In accordance with the above explanation of the guide means according to the present invention it is ensured that members 10*a*, 10*b* of the supporting member are provided to be in alignment with the connecting parts 8*a*, 8*b*. According to a modified embodiment the support 12 is mounted angle-offset to a vertical axis so that members 10*a*, 10*b* rotate or are offset in angle about a prescribed angle with respect to the connecting parts 8*a*, 8*b*, as a result of which the cables 7*a*, 7*b* slightly turn about the vertical axis. In this embodiment members 10*a*, 10*b* fail to align with respect to the connecting parts 8*a*, 8*b*. The sense and purpose of this embodiment is to convert the starting position of the submersible mixer as defined by the connecting parts 8*a*, 8*b* in its downwards movement into a, thereto, slightly turn-angled operating position so as to employ the submersible mixer defined in a prescribed direction within the corresponding receptacle, thus making it possible to introduce into the corresponding receptacle apertures either a plurality of submersible mixers within a single receptacle or a plurality of submersible mixers in a series of receptacles by means of merely a single winch crane running on a traveller. By further lowering the submersible mixers they are brought into a prescribed working position as determined by the positioning of the support 12.

It may be of advantage to provide on each connecting part 16 centering means comprising, for example, a plurality of guide members 80 tapered downwards provided distributed around the circumference of the connector 16 to come into contact with the tubular post sections 60, 61 of the guide slide when in the UP position. The centering means 80 has the task of limiting the movement of the guide slide in the UP position with respect to the connecting parts 16, more particularly to prevent an excessive shift in position in the horizontal direction. One preferred embodiment of the centering means 80 is shown in FIG. 9.

What is claimed and desired to secure by Letters Patent is:

1. A submersible mixer having a guiding means for guiding the submersible mixer in a receptacle having an aperture on its upper side, comprising:

two guiding members which are located substantially parallel to each other;

said guiding members comprising upper and lower ends, said upper ends being fixed in said receptacle;

said guiding members including cable sections;

further comprising:

connectors for securing said cable sections in said aperture of said receptacle;

supporting members which are arranged on the bottom of said receptacle and being provided for receiving said cable sections;

further comprising:

a guiding slide being provided with two tubular posts which are arranged parallel to each other, said tubular posts having a lower end being taper-extended;

said supporting members being conically tapered for achieving smooth placement of said tubular posts on said supporting members;

said submersible mixer comprising:

a frame being detachable on said guiding slide, said guiding slide comprising connecting elements adapted for alternatively fixing said frame of said guiding slide permitting the frame to be lowered along said guiding members and for fixing said guiding slide against the aperture of said receptacle so that said frame is permitted to be detached from said guiding slide.

2. A submersible mixer according to claim 1, wherein said tubular posts of said guiding slides are spaced apart by connecting means.

3. A submersible mixer according to claim 1, wherein said tubular posts have an internal diameter being larger than the outer diameter of said bottom supporting members.

4. A submersible mixer according to claim 1, wherein said support members are provided with connecting means.

5. A submersible mixer having a guiding means for guiding the submersible mixer in a receptacle having an aperture on its upper side, comprising:

two guiding members which are located substantially parallel to each other;

said guiding members comprising upper and lower ends, said upper ends being fixed in said receptacle;

said guiding members including cable sections;

further comprising:

connectors for securing said cable sections in said aperture of said receptacle;

supporting members which are arranged on the bottom of said receptacle and being provided for receiving said cable sections;

further comprising:

a guiding slide being provided with two tubular posts which are arranged parallel to each other, said tubular posts having a lower end being taper-extended;

said supporting members being conically tapered for achieving smooth placement of said tubular posts on said supporting members;

said submersible mixer further comprising:

a frame being detachable on said guiding slide, said guiding slide comprising connecting elements adapted for alternatively fixing said frame against said guiding slide permitting the frame to be lowered along said guiding members and for fixing said guiding slide against the aperture of said receptacle so that said frame is permitted to be detached from said guiding slide, further comprising:

means for spacing said supporting members from the bottom of said receptacle.

6. A submersible mixer having a guiding means for guiding the submersible mixer in a receptacle having an aperture on its upper side, comprising:

two guiding members which are located substantially parallel to each other;

said guiding members comprising upper and lower ends, said upper ends being fixed in said receptacle;

said guiding members including cable sections;

further comprising:

connectors for securing said cable sections in said aperture of said receptacle;

supporting members which are arranged on the bottom of said receptacle and being provided for receiving said cable sections;

further comprising:

a guiding slide being provided with two tubular posts which are arranged parallel to each other, said tubular posts having a lower end being taper-extended;

said supporting members being conically tapered for achieving smooth placement of said tubular posts on said supporting members;

said submersible mixer further comprising:

a frame being detachable on said guiding slide, said guiding slide comprising connecting elements adapted for alternatively fixing said frame against said guiding slide permitting the frame to be lowered along said guiding members and for fixing said guiding slide against the aperture of said receptacle so that said frame is permitted to be detached from said guiding slide;

further comprising:

means for spacing said supporting members from the bottom of said receptacle, wherein said means for spacing said supporting members comprises struts oriented at an angle to the bottom of said receptacle.

7. A submersible mixer having a guiding means for guiding the submersible mixer in a receptacle having an aperture on its upper side, comprising:

two guiding members which are located substantially parallel to each other;

said guiding members comprising upper and lower ends, said upper ends being fixed in said receptacle;

said guiding members including cable sections;

further comprising:

connectors for securing said cable sections in said aperture of said receptacle;

supporting members which are arranged on the bottom of said receptacle and being provided for receiving said cable sections;

further comprising:

a guiding slide being provided with two tubular posts which are arranged parallel to each other, said tubular posts having a lower end being taper-extended;

said supporting members being conically tapered for achieving smooth placement of said tubular posts on said supporting members;

said submersible mixer comprising:

a frame being detachable on said guiding slide, said guiding slide comprising connecting elements adapted for alternatively fixing said frame against said guiding slide permitting the frame to be lowered along said guiding members and for fixing said guiding slide against the aperture of said receptacle so that said frame is permitted to be detached from said guiding slide;

further comprising:

two substantially channel-shaped sections extending sideways, by means of which said frame of said submersible mixer can be placed on said guiding slide.

8. A submersible mixer having a guiding means for guiding the submersible mixer in a receptacle having an aperture on its upper side, comprising:

two guiding members which are located substantially parallel to each other;

said guiding members comprising upper and lower ends, said upper ends being fixed in said receptacle;

said guiding members including cable sections;

further comprising:

connectors for securing said cable sections in said aperture of said receptacle;

supporting members which are arranged on the bottom of said receptacle and being provided for receiving said cable sections;

further comprising:

a guiding slide being provided with two tubular posts which are arranged parallel to each other, said tubular posts having a lower end being taper-extended;

said supporting members being conically tapered for achieving smooth placement of said tubular posts on said supporting members;

said submersible mixer comprising:

a frame being detachable on said guiding slide, said guiding slide comprising connecting elements adapted for alternatively fixing said frame against said guiding slide permitting the frame to be lowered along said guiding members and for fixing said guiding slide against the aperture of said receptacle so that said frame is permitted to be detached from said guiding slide;

further comprising:

two substantially channel-shaped sections extending sideways, by means of which said frame of said submersible mixer can be placed on said guiding slide, wherein said channel-shaped sections are shifted on said tubular posts of said guiding slide when said frame is lowered.

9. A submersible mixer having a guiding device for guiding the submersible mixer in a receptacle having an aperture, the device comprising:

at least two guide members substantially parallel to each other, the guide members including cable sections having upper and lower ends, the upper ends being fixed to the receptacle;

at least two supporting members mounted to a bottom surface of the receptacle, the supporting members receiving the lower ends of the cable sections;

a guide slide having at least two vertical tubular posts slidably coupled to the cable sections, the tubular posts having taper-extended lower ends;

wherein the supporting members are conically tapered for receiving and smooth placement of the tubular posts on the supporting members; and at least two connecting elements secured to the guide slide and adapted to be alternatively attached to the receptacle and to the submersible mixer for alternatively fixing the guide slide to the receptacle and permitting the guide slide including the submersible mixer to move along the cable sections.

10. A submersible mixer according to claim 9, further comprising means for connecting the tubular posts to each other.

11. A submersible mixer according to claim 9, wherein the tubular posts have an internal diameter that is larger than an outer diameter of the supporting members.

12. A submersible mixer according to claim 9, wherein the supporting members are mounted in a support, the support connecting the supporting members to each other.

13. A submersible mixer having a guiding device for guiding the submersible mixer in a receptacle having an aperture, the device comprising:

at least two guide members substantially parallel to each other, the guide members including cable sections having upper and lower ends, the upper ends being fixed to the receptacle;

at least two supporting members mounted to a bottom surface of the receptacle, the supporting members receiving the lower ends of the cable sections;

a guide slide having at least two vertical tubular posts slidably coupled to the cable sections, the tubular posts having taper-extended lower ends;

wherein the supporting members are conically tapered for receiving and smooth placement of the tubular posts on the supporting members; and at least two connecting elements secured to the guide slide and adapted to be alternatively attached to the receptacle and to the submersible mixer for alternatively fixing the guide slide to the receptacle and permitting the guide slide including the submersible mixer to move along the cable sections; and means for spacing the supporting members a distance from the bottom surface of the receptacle.

14. A submersible mixer having a guiding device for guiding the submersible mixer in a receptacle having an aperture, the device comprising:

at least two guide members substantially parallel to each other, the guide members including cable sections having upper and lower ends, the upper ends being fixed to the receptacle;

at least two supporting members mounted to a bottom surface of the receptacle, the supporting members receiving the lower ends of the cable sections;

a guide slide having at least two vertical tubular posts slidably coupled to the cable sections, the tubular posts having taper-extended lower ends;

wherein the supporting members are conically tapered for receiving and smooth placement of the tubular posts on the supporting members; and at least two connecting elements secured to the guide slide and adapted to be alternatively attached to the receptacle and to the submersible mixer for alternatively fixing the guide slide to the receptacle and permitting the guide slide including the submersible mixer to move along the cable sections; and struts oriented at an acute angle to the bottom surface of the receptacle, the struts being positioned to space the supporting members a distance from the bottom surface of the receptacle.

15. A submersible mixer having a guiding device for guiding the submersible mixer in a receptacle having an aperture, the device comprising:

at least two guide members substantially parallel to each other, the guide members including cable sections having upper and lower ends, the upper ends being fixed to the receptacle;

at least two supporting members mounted to a bottom surface of the receptacle, the supporting members receiving the lower ends of the cable sections;

a guide slide having at least two vertical tubular posts slidably coupled to the cable sections, the tubular posts having taper-extended lower ends;

wherein the supporting members are conically tapered for receiving and smooth placement of the tubular posts on the supporting members;

at least two connecting elements secured to the guide slide and adapted to be alternatively attached to the receptacle and to the submersible mixer for alternatively fixing the guide slide to the receptacle and permitting the guide slide including the submersible mixer to move along the cable sections; and a frame coupled to the submersible mixer, the frame including first and second substantially channel-shaped sections sized to securely fit around the tubular posts.

16. A submersible mixer having a guiding device for guiding the submersible mixer in a receptacle having an aperture, the device comprising:

at least two guide members substantially parallel to each other, the guide members including cable sections having upper and lower ends, the upper ends being fixed to the receptacle;

at least two supporting members mounted to a bottom surface of the receptacle, the supporting members receiving the lower ends of the cable sections;

a guide slide having at least two vertical tubular posts slidably coupled to the cable sections, the tubular posts having taper-extended lower ends;

wherein the supporting members are conically tapered for receiving and smooth placement of the tubular posts on the supporting members;

at least two connecting elements secured to the guide slide and adapted to be alternatively attached to the receptacle and to the submersible mixer for alternatively fixing the guide slide to the receptacle and permitting the guide slide including the submersible mixer to move along the cable sections; and a frame coupled to the submersible mixer, the frame including first and second substantially channel-shaped sections extending parallel to the tubular posts, the sections being adapted to shift on the tubular posts when the submersible mixer is lowered onto the guide slide to mount the submersible mixer to the guide slide.

* * * * *